US006484527B1

(12) United States Patent
Paul

(10) Patent No.: US 6,484,527 B1
(45) Date of Patent: Nov. 26, 2002

(54) METHOD FOR OPERATING A REFRIGERATING SYSTEM

(75) Inventor: Joachim Paul, Flensburg (DE)

(73) Assignee: Integral Energietechnik, GmbH, Flensburg (DE)

( * ) Notice: Subject to any disclaimer, the term of this patent is extended or adjusted under 35 U.S.C. 154(b) by 0 days.

(21) Appl. No.: 09/786,892

(22) PCT Filed: Aug. 31, 1999

(86) PCT No.: PCT/DE99/02796

§ 371 (c)(1),
(2), (4) Date: Mar. 9, 2001

(87) PCT Pub. No.: WO00/16024

PCT Pub. Date: Mar. 23, 2000

(30) Foreign Application Priority Data

Sep. 11, 1998 (DE) ..... 198 41 548

(51) Int. Cl.[7] ..... F25B 7/00

(52) U.S. Cl. ..... 62/305; 62/335; 62/506

(58) Field of Search ..... 62/305, 335, 506, 62/507

(56) References Cited

U.S. PATENT DOCUMENTS

| | | | | | |
|---|---|---|---|---|---|
| 1,933,703 | A | * | 11/1933 | Brus et al. | 62/305 |
| 1,975,945 | A | * | 10/1934 | Hopkins | 62/305 |
| 2,353,233 | A | * | 7/1944 | Gygax | 62/305 |
| 2,672,024 | A | * | 3/1954 | McGrath | 62/305 |
| 3,824,804 | A | * | 7/1974 | Sandmark | 62/335 |
| 4,869,069 | A | * | 9/1989 | Scherer | 62/335 |
| 4,918,943 | A | * | 4/1990 | Faust | 62/305 |
| 5,687,579 | A | * | 11/1997 | Vaynberg | 62/335 |

* cited by examiner

*Primary Examiner*—William E. Tapolcai
(74) *Attorney, Agent, or Firm*—Larson & Larson, PA

(57) ABSTRACT

Method for operating refrigerating plants in which a thermal coupling of an electromotively and/or mechanically driven compression refrigerating plant with a thermally supplied refrigerating plant takes place in such a way that the compression refrigerating plant condenser is cooled by the thermally supplied refrigerating plant.

7 Claims, 2 Drawing Sheets

METHOD FOR OPERATING A REFRIGERATING SYSTEM

PRIOR APPLICATIONS

This application is a §371 U.S. National Phase application which bases priority on International Application No. PCT/DE99/02796, filed Aug. 31, 1999, which in turn bases priority on German Application No. DE 198 41 548.6, filed Sep. 11, 1998.

BACKGROUND OF THE INVENTION

1. Field of Invention

The invention relates to a method for operating a refrigerating plant.

2. Description of the Prior Art

Apart from electric power and/or mechanical energy, increasingly thermal energy in the form of warm water, hot water and steam is used for driving refrigerating machines. This thermal energy can e.g. be district heating, which is in part available in excess form in summer from heating power stations (HPSs) and block heating power stations (BHPSs). Waste heat from industrial processes or solar/geothermal energy can also be used as motive energy.

Particularly in summer the district heating thermal energy and solar energy are particularly attractive for the operation of refrigerating plants, because this energy becomes available at the precise time when cold is e.g. needed for summer air conditioning. Thermal energy is also an option for refrigerating plants operated throughout the year.

A special type of problem e.g. arises in the case of refrigerating plants operated throughout the year and which are supplied with heat from BHPSs. Other than for heating purposes in winter, in summer this heat is difficult to sell. The summer demands are largely limited in the residential and industrial areas to service water heating. However, in the case of current-carrying power-heat coupling there is necessarily an excess waste heat availability, which could be usefully paid off by means of a power-heat-cold coupling.

The temperature level in a district heating network is in winter typically 100 to 130° C., whereas in summer it is lowered to values around 90° C. The usable temperature level of the waste heat of internal combustion engines of a BHPS is by design typically 90° C., apart from hot-cooled engines or pure exhaust gas utilization. These examples show that in numerous cases temperatures around 90° C. are expected, making difficult a use for cold generation purposes.

Apart from a low efficiency with hot water, steel equipment at such low temperatures suffer from a problem which, although not unsolvable, is difficult to implement from an ecological and economic standpoint. Admittedly water/lithium bromide absorption refrigerating plants can be operated with such low temperatures, but with the low efficiency levels achieved have difficulties in providing cold water at e.g. 6° C. Admittedly ammonia/water absorption refrigerating plants can reach temperatures below 6° C. and even below 0° C., but the costs are very high and the efficiency once again low. Mention is finally made of adsorption plants, which admittedly can cope with low temperatures, but are expensive to purchase, very large, heavy and also very energy-intensive.

In many hot countries the power consumption in summer is high and often higher than in winter, because the numerous electric room cooling devices lead to pronounced current peaks, which have to be expensively covered and often lead to overloading of the main supply networks. In cooler countries the power consumption in winter is admittedly high, but at the same time in the case of power-heat coupling the heat demand for heating purposes is also high and a BHPS can e.g. favorably cover the parallel energy requirement by full load operation. In summer, due to the limited heating heat requirement, a reduction of the power generation is favorable, because room cooling equipment in cool countries provide no significant contribution to the power consumption and the peaks are not or are less pronounced than in hot countries.

In both the cases described (not and cold countries), the re is consequently a wish, even though for completely different reasons, to use thermal energy in summer for operating a refrigerating plant. Winter operation with thermal energy is often impossible (no solar heat production), undesired (already existing high heating heat demand) or uneconomic (due to seasonly higher returns from heat sales for heating purposes).

The problem of the invention is to provide a method which permits a particularly economic operation of a refrigerating plant.

SUMMARY OF THE INVENTION

According to the invention this problem is solved by a thermal coupling of an electromotively and/or mechanically driven compression refrigerating plant with a thermally supplied refrigerating plant in such a way that the condenser of the compression refrigerating plant is cooled by the thermally supplied refrigerating plant. The subclaims contain advantageous developments of the invention.

Refrigerating plants with an electrical or mechanical drive are generally constructed as compression refrigerating plants. The energy requirement for driving a compressor is dependent on the evaporation and condensation temperature. As the evaporation temperature is generally fixed by the cold application, with regards to the compressor energy demand scope only exists when fixing the condensation temperature, which should be as low as possible with rising condensation temperature it is e.g. appropriate to operate with cooling water from a cooling tower, condensation of the refrigerant in an evaporative cooler or condensation with an air-cooled condenser. The use of cooling towers and evaporative coolers is being made ever more difficult or is even prohibited, because the water demands are considerable. Air cooling is the least favorable solution to the high temperature, although no water is consumed.

For a low temperature of the thermal motive energy, refrigerating plants with a thermal drive are normally absorption refrigerating plants. At the prevailing low temperatures it is difficult and/or energy-intensive, to make available usable use temperatures. At the low temperature of the thermal motive energy a high use temperature is increasingly more economic. With respect to the condensation of the refrigerant and the removal of the absorption heat the same criteria apply as in a compression refrigerating plant.

If the compression refrigerating plant is equipped with an air-cooled condenser, it can condense the refrigerant in winter at a low external temperature without cooling by the adsorption refrigerating plant in the case of low energy demand. The adsorption refrigerating plant can then be switched off or used for other purposes.

Thus, in winter the low air temperature for condenser cooling of the compression refrigerating plant reduces the electrical or mechanical energy demand thereof. The adsorption refrigerating plant can remain switched off if thermal motive energy is scarce or expensive. The adsorption refrigerating plant can also be used for other cooling or refrigerating functions if a need exists. In this case there are two autarchic refrigerating plants. In summer the adsorption refrigerating plant is operated with existing and/or inexpensive (free) thermal motive energy. The adsorption refrigerating plant serves to cool the condenser of the compression refrigerating plant, so that the electric or mechanical energy requirement of the compression refrigerating plant is low. Simultaneously the use temperature of the adsorption refrigerating plant is high, e.g. the refrigerant is condensed with an air-cooled condenser without any consumption of water. Water cooling of the condenser is obviously also possible.

The following construction is proposed for an advantageous coupling of the compression refrigerating plant condenser with the adsorption refrigerating plant. The adsorption refrigerating plant is constructed as a water cooler (for frost or corrosion protection reasons it is also possible to use another liquid, e.g. a brine, included hereinafter under "water"). The compression refrigerating plant is a bare or finned conduit condenser, the refrigerant to be condensed flowing through the pipes and the cooling air around the pipes. Fans ensure the air flow and they are conventionally exhaust fans.

With a low outside temperature (e.g. in the case of cold winter weather) the condenser of the compression refrigerating plant is cooled with external air. With high outside temperatures the compression refrigerating plant condenser is cooled with cold water from the adsorption refrigerating plant. For this purpose the compression refrigerating plant condenser is flooded with cold water from the adsorption refrigerating plant.

DESCRIPTION OF THE DRAWINGS

The invention is described in greater detail hereinafter relative to the attached drawings, wherein show.

DETAILED DESCRIPTION OF THE PREFERRED EMBODIMENT

Figure 1:
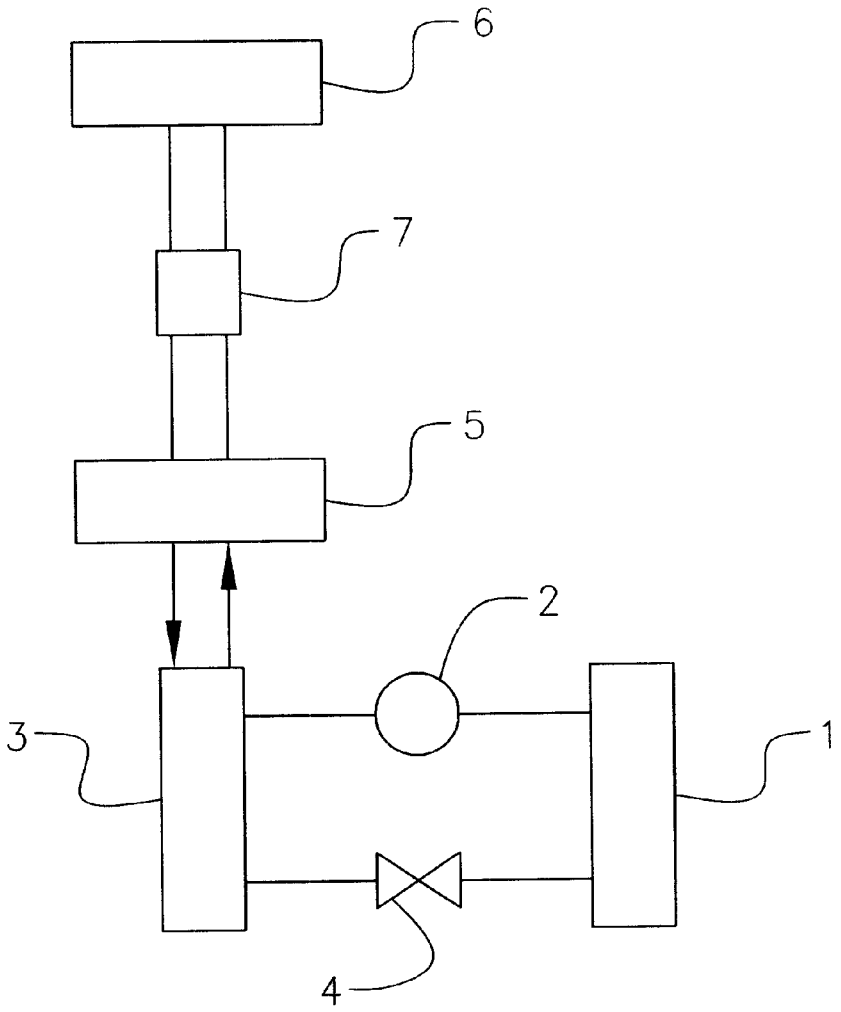
FIG. 1 A basic diagram illustrating the method.

A compression refrigerating plant comprising an evaporator 1, a compressor 2, a condenser 3 and a throttling member 4 is coupled to an adsorption refrigerating plant essentially comprising an evaporator 5, a condenser 6 and an absorber/desorber part 7. The compression refrigerating plant is driven electrically or mechanically, whilst the absorber is supplied with thermal energy. Thus, the low use temperature is provided by an electrically/mechanically driven compression refrigerating plant and simultaneously the condensation temperature of the compression refrigerating plant is kept low by cooling with the adsorption refrigerating plant. Thus, the adsorption refrigerating plant with low temperature thermal energy can keep the energy demand of the compression refrigerating plant much lower than would be possible without the adsorption refrigerating plant. The adsorption refrigerating plant does not have to supply cold at low temperatures and can therefore be economically operated at high condensation temperatures. The adsorption portion can be a jet apparatus.

Figure 2:
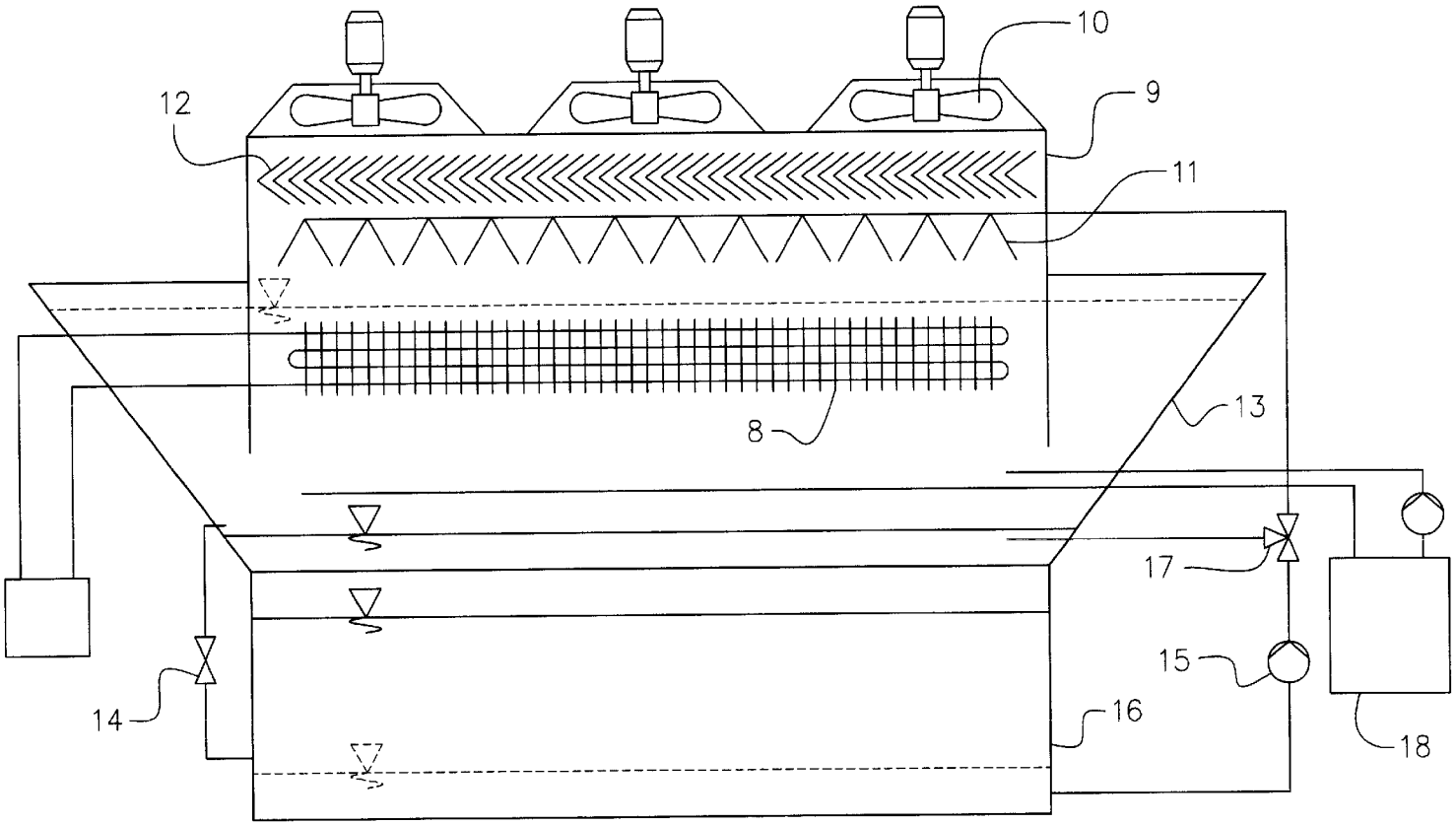
FIG. 2 A diagrammatic representation of a plant suitable for performing the method.

FIG. 2 shows an example of such a plant. The air-cooled heat exchanger 8 is located in a casing 9, on whose top are located exhaust fans 10. Thus, air flow takes place from bottom to top. Above the heat exchanger 8 and below the fans 10 is provided a water sprinkling device 11. As a function of the geometry, air speed and sensitivity of the fans 10 mist eliminators 12 are located above the water sprinkling device 11 and below the fans 10 the casing 9 with elements 8, 10, 11, 12 and necessary accessories, e.g. electric cabling, switch gear, controls, drive motors, etc. are in a trough 13 in such a way that said trough 13 can be emptied e.g. by a valve-operated discharge commercially available air-cooled apparatus.

If the heat exchanger 8 is to be flooded in order to cool the condenser with the adsorption refrigerating plant in the case of high outside temperatures, the discharge device 14 is closed and a pump 15 delivers water from a receiver 16 into the trough 13. In the case of a high outside temperature, i.e. if the heat exchanger 8 is to be flooded, a three-way valve 17 opens in such a way that the pumped water flows into the trough 13. The water level in the trough 13 is controlled in such a way that the heat exchanger 8 is completely immersed, the fans 10 remaining switched off. The adsorption refrigerating plant 18 cools the water in trough 13 or receiver 16. As a result of the cooling by the adsorption refrigerating plant the condensing temperature of the compression refrigerating plant is low and consequently the energy demand of the compression refrigerating plant is also kept low.

In the case of mild outside temperatures, e.g. in the spring and autumn, it is possible to operate the condenser as an evaporative cooler with uncooled water from the receiver 16 and by sprinkling water over the condenser; it then being possible to leave the adsorption refrigerating plant switched off.

By means of the mist eliminator 12, water droplets and aerosols can be prevented from entering the fans 10. The trough 13 can be provided with an overflow or a suitable control device to prevent overfilling of the trough 13. In place of water cooling in the trough 13, the adsorption refrigerating plant can also be used for cooling or precooling in the receiver 16. It is also possible to continuously drain the water by means of the discharge device 14 and allow it to enter via the pump 15.

The trough 13 is preferably constructed with sloping side walls, which does not or does not significantly impede or even improves the inflow of air. For this purpose it is e.g. possible to use not shown guides, which can also contribute to a more uniform flow.

Having thus described the invention, what is claimed and desired to be secured by Letters Patent is:

1. A refrigeration plant having a compression portion thermally coupled to an adsorption portion, the refrigeration plant comprising:

a) the compression portion having a condenser coupled to an evaporator, and a trough, b) the compression portion condenser having a heat exchanger located within the trough, the heat exchanger subjected to either cold water or cold air depending on a temperature of external air surrounding the refrigeration plant, c) a liquid receiving tank retaining a liquid source, d) a pump coupled between the receiving tank and the trough for supplying the liquid source from the receiving tank to the trough during high external air temperatures such that the heat exchanger is completely submerged with cold water, and e) a valve operated discharge device coupled between the receiving tank and the trough for expelling the liquid source from the trough and into the receiving tank during low external air temperatures so that the heat exchanger can be subjected to external cold air.

2. The refrigeration plant of claim 1, wherein the adsorption portion is a jet apparatus.

3. The refrigeration plant of claim 1, further comprising a plurality of exhaust fans located above the heat exchanger.

4. The refrigeration plant of claim 3, further comprising:

a) a water sprinkling device mounted between the heat exchanger and the plurality of exhaust fans, and b) a mist eliminator mounted between the water sprinkling device and the plurality of exhaust fans.

5. The refrigeration plant of claim 4, wherein the heat exchanger, the plurality of exhaust fans, the water sprinkling device and the mist eliminators are all enclosed within a casing.

6. A refrigeration plant having a compression portion thermally coupled to an adsorption portion, the refrigeration plant comprising:

a) the compression portion having a condenser coupled to an evaporator, and a trough, b) the compression portion condenser having a heat exchanger located within the trough, the heat exchanger subjected to either cold water or cold air depending on a temperature of external air surrounding the refrigeration plant, c) a sprinkling device positioned above the heat exchanger, d) a lizuid receiving tank retaining a liquid source, e) a pump coupled between the receiving tank and the trough for supplying the liquid source from the receiving tank to the trough during high external air temperatures such that the heat exchanger is completely submerged with cold water, and f) a valve operated discharge device coupled between the receiving tank and the trough for expelling the liquid source from the trough and into the receiving tank during low external air temperatures so that the heat exchanger can be subjected to external cold air.

7. The refrigeration plant of claim 6, further comprising a plurality of exhaust fans located above the heat exchanger.

* * * * *